United States Patent [19]

Morfitt

[11] 4,058,295

[45] Nov. 15, 1977

[54] SMALL, VARIABLE-SPEED YARDER

[75] Inventor: John B. Morfitt, Langley, Canada

[73] Assignee: Lantec Industries, Ltd., Langley, Canada

[21] Appl. No.: 621,512

[22] Filed: Oct. 10, 1975

[51] Int. Cl.[2] ..... B66D 1/26

[52] U.S. Cl. ..... 254/184; 212/76

[58] Field of Search ..... 254/184; 212/58, 76, 212/84, 89

[56] References Cited

U.S. PATENT DOCUMENTS

| | | | |
|---|---|---|---|
| 3,107,791 | 10/1963 | Michael | 254/184 |
| 3,405,878 | 10/1968 | Lawrence | 254/184 |

FOREIGN PATENT DOCUMENTS

| | | | |
|---|---|---|---|
| 952,511 | 8/1974 | Canada | 254/184 |

*Primary Examiner*—Robert J. Spar
*Assistant Examiner*—Donald W. Underwood
*Attorney, Agent, or Firm*—Seed, Berry, Vernon & Baynham

[57] ABSTRACT

A small, variable-speed yarder is provided with main, haulback and slack-pulling drums, each containing a planetary drive transmission with provisions for dual power inputs. A variable interlock mechanism controls the relative speed of the haulback drum to the two inhaul drums (main and slack-pulling) and a differential drive mechanism controls the relative speed and/or direction of the inhaul drums.

5 Claims, 3 Drawing Figures

SMALL, VARIABLE-SPEED YARDER

BACKGROUND OF THE INVENTION

1. Field of the Invention

This invention pertains to infinite-ratio driving connections between two or more interlocked drums. More specifically, it pertains to an improved interlock drive and slack-pulling arrangement for a log yarding system.

2. Description of the Prior Art

Most logging yarders employ at least a main drum and a haulback drum with corresponding wire ropes wrapped on the drums. The function of these drums is to spool back and forth the main and haulback lines of a log-hauling cable. As is well known, the lines are strung between the yarder and tail-block located at the extreme outer limit of the area being logged. A choker or grapple is attached to the main line. When the carriage is being hauled out or hauled in, it is necessary to pay out one of the lines as the other is being spooled in and to maintain the same speed when wraps on the drums change to affect the speed so as to maintain the lines sufficiently taut such that the logs are not dragged along the ground.

When the chokers or grapple are positioned over the logs, relative movement is necessary between the drums to allow the grapple or choker lines to be dropped down to the logs. Thus it is also necessary in a yarder that the haulback and main drums to be operated at different speeds relative to one another.

Interlock mechanisms between the two drums have been used heretofore to enable the two drums to run at correlated relative speeds of rotation through planetary gear systems. Typical examples of these types of yarders are described in U.S. Pat. Nos. 3,405,878 and 3,733,812. Basically, the prior systems, however, are expensive to manufacture and thus too costly to use in lower priced, smaller capacity yarders.

Grapple operation requires that the yarder provide a means of lowering, opening and closing the grapple. For this purpose, a slack-pulling drum with a corresponding slack-pulling line is provided, and the yarder system is called a three-drum or three-line yarder. Similarly, in other three-line yarders, a slack-pulling line is provided to extend and retract choker cables. All known three-line yarders require brakes and clutches to effectively operate the third slack-pulling drum. Elimination of these components simplifies the operation of the yarder unit and reduces the manufacturing expense.

SUMMARY OF THE INVENTION

It is an object of this invention to provide an improved planetary drive transmission for a yarder.

It is another object of this invention to provide an improved interlock drive mechanism for at least a two-drum yarder.

These objects are best obtained by providing at least main and haulback drums and corresponding lines, primary drive means for rotating the drums through at least one planetary drive transmission which is contained substantially within the confines of one of the drums and having two input drives and one output drive, and an interlock control means going to one of the input drives of the planetary drive transmission train to control relative speed and direction of rotation between the two drums.

It is another object of this invention to provide an improved three-line yarder.

It is still another object of the invention to provide an improved and simplified three-line yarder having a differential drive transmission between the two inhaul drums.

Basically, these objects are obtained by providing three planetary drive systems independently connected to each of the three drums of the yarder with the primary drive to each drum via the planet carrier and the control to each via the sun gear. A secondary drive motor connected to the haulback sun gear controls the interlock tension, and a secondary drive motor differentially powering the sun gears in the main and slack-pulling drums actuates the slack-pulling mechanism.

The differentially powered sun gears in the main and slack-pulling drums provide (1) a 1:1 driving ratio in opposite directions between each drum to raise or lower a load in a choker carriage or operate the grapple in a grapple carriage when the carriage is stationary over the load, (2) the capability to vary the relative speeds of the main and slack-pulling drums while traveling (in hauling or out hauling) to compensate for changes in line speed due to changes in the wraps on the drums, and (3) the capability to vary the relative speeds of the main and slack-pulling drums while approaching a load site or landing site to adjust the vertical position of the chokers while outhauling or the vertical position of the load relative to the carriage while in hauling in a choker carriage or open and close the grapple while traveling. Differential as used herein is not to be limited to a geared differential drive train but includes all mechanical and hydraulic equivalents which are capable of producing a differential motion.

In a preferred embodiment, a three-line logging yarder is employed. The inventive feature, however, of providing the primary and secondary power motive means to the two inputs of a planetary drive transmission is believed to be unique and of value for less sophisticated two-line yarders as well. The estimated overall cost savings of this unique planetary drive transmission and controls for a typical three-line yarder of up to 30,000 pounds cable tension can be as much as $50,000 per yarder. In addition, the operator will have superior control of the lines of the yarder when in use.

DETAILED DESCRIPTION OF THE PREFERRED EMBODIMENTS

Figure 1:
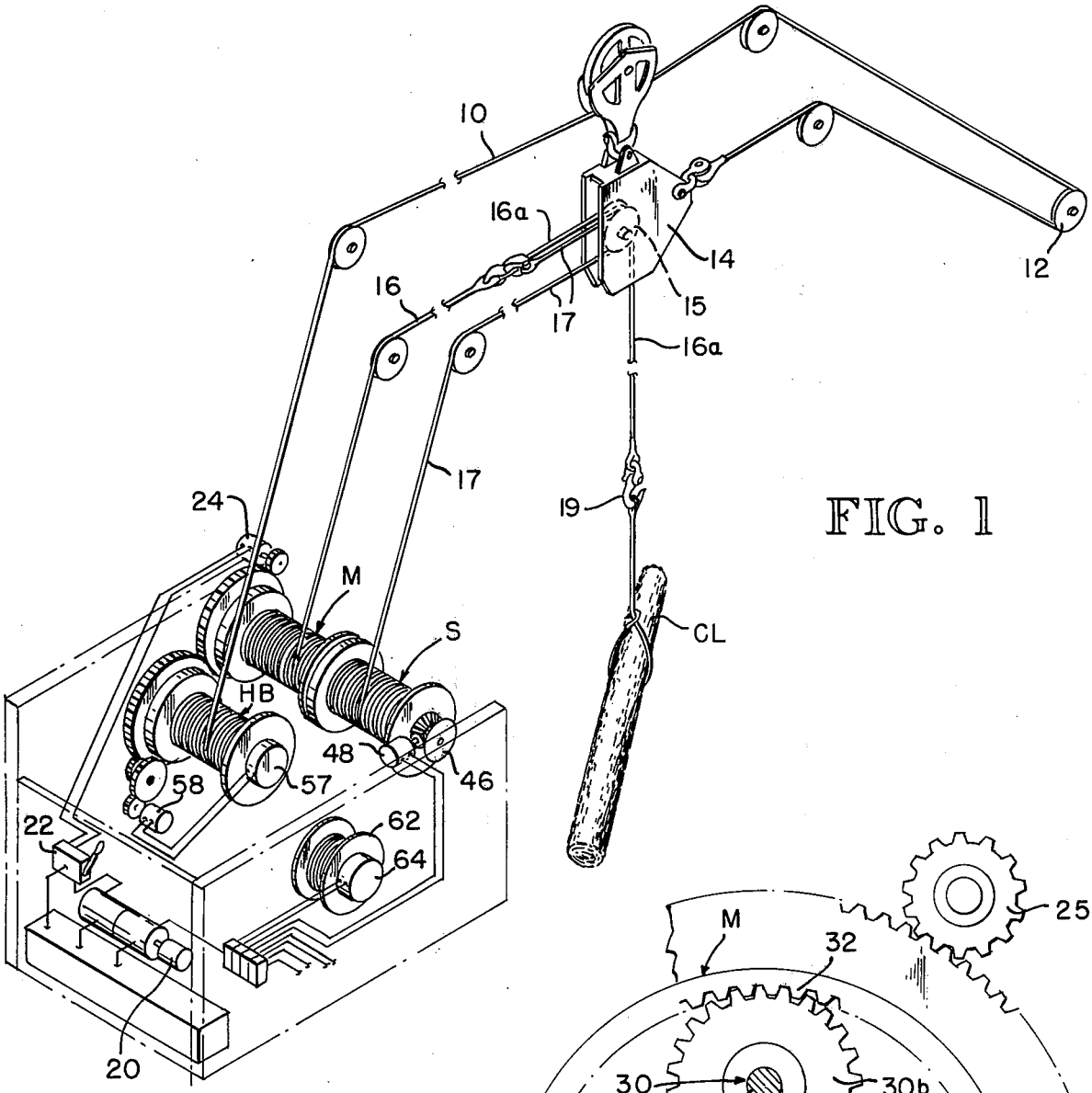
FIG. 1 is a schematic illustration of a typical three-line yarding system embodying the principles of the invention.

In the three-line yarder illustrated, a haulback line 10 is wrapped on a haulback drum HB and about a set of tailblocks 12 which are secured to stumps at the end of the logging area. The haulback line is then attached to a carriage 14, which, in the yarding system illustrated, is a slack-pulling choker carriage. A main line 16 is wrapped on a main drum M and a slack-pulling line 17 is wrapped on a slack-pulling drum S. The main line and slack-pulling lines pass over grooves in a sheave 15. A typical operation is to spool in on the haulback line while simultaneously spooling out on the slack-pulling and main lines to move the carriage over the load. Next, the main line will be spooled out further, while the slack-pulling line is spooled in to lower hook 19 and choker cables CL to the ground. In actual operation the main line will merely be spooled out faster than the stack-pulling line is spooled out while the carriage is approaching the loading site so that the chokers are already lowered when the carriage is stopped over the load. The hook 19 is on a main line extension 16*a*. Next, the main and slack-pulling lines are reversed to lift the logs. The main and slack-pulling lines are moved in opposite directions at the same speed when lifting the logs to keep the carriage aboveground. Next, the haulback line is spooled out while the slack-pulling line and main line are simultaneously spooled in to deliver the load to the landing. Finally, the main line is spooled out, while the slack-pulling line is pulled in to lower the logs to the ground.

As is apparent, in order to maintain the carriage high enough above the ground to avoid dragging the log through stumps and the like, the sag or deflection in all three operating lines must be limited and controlled. For this purpose, it is desirable to interlock the drives for the main and haulback drums so that a desired tension is maintained in the lines while maintaining the carriage suspended and to maintain tension in the slack-pulling line as well.

Figure 3:
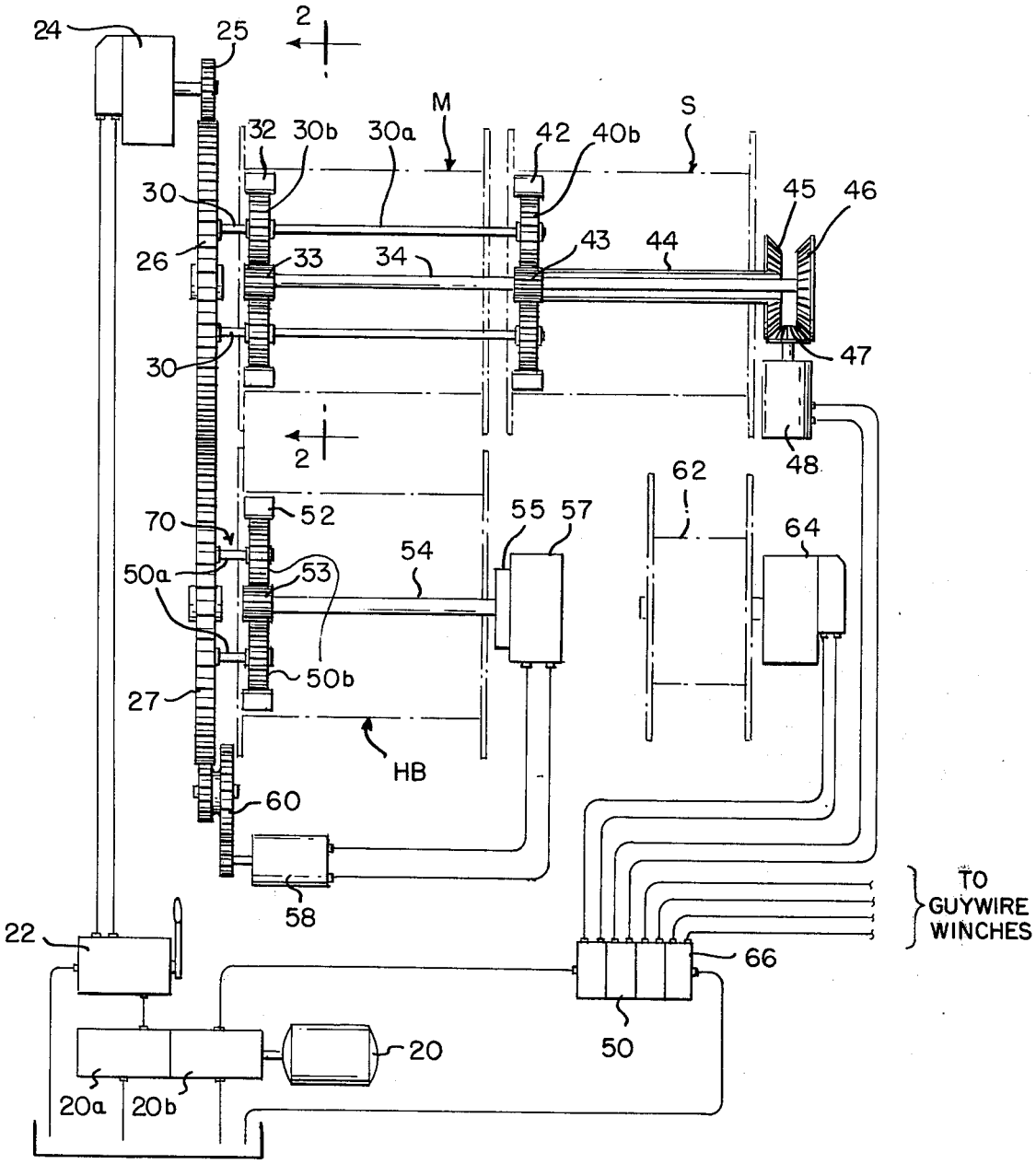
FIG. 3 is a schematic illustration of a two-speed, three-line yarder embodying the principles of the invention.

As shown diagrammatically in FIG. 3, the preferred embodiment of the driving mechanism includes a diesel powered engine or other prime mover 20 that drives a pair of fixed displacement tandem pumps 20*a* and 20*b*. Pump 20*a* provides fluid through a conventional manually operated speed and directional flow control valve 22 to a conventional reversible, variable-speed primary motive means, such as, hydraulic motor 24. The hydraulic motor powers a pinion gear 25 which meshes with a first bull gear 26. The first bull gear 26 in turn meshes with a second bull gear 27.

Figure 2:
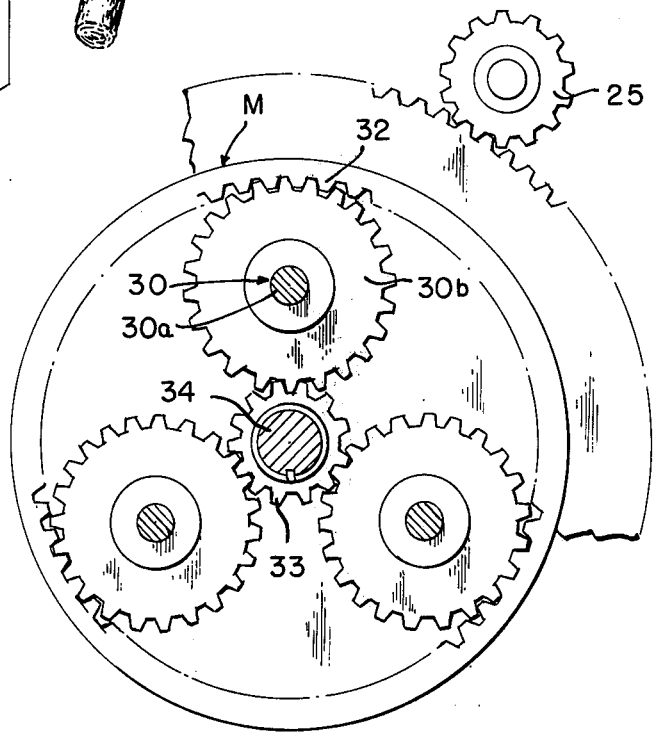
FIG. 2 is a fragmentary section taken along the line 2—2 of FIG. 3.

As best shown in FIGS. 2 and 3, each drum is provided with a substantially identical planetary gear or transmission as will be described. Secured to the bull gear 26 is a first input drive or conventional planet carrier 30 having three spindles 30*a* on which are rotatably mounted planet gears 30*b*. The preferred embodiment will employ three planet gears in each planetary drive transmission, as best illustrated in FIG. 2. The planet gears mesh respectively with an internal gear 32 and a sun gear 33. The sun gear forms part of a second input drive whereas the internal gear 32 forms part of an output drive. The internal gear is integrally secured to the inside of the main drum M, whereas the sun gear is keyed to a shaft 34. As is well understood, rotation of the bull gear 26 will rotate the planet carrier 30, causing the planet gears to rotate about the sun gear 33 as well as about the spindles 30*a* if the sun gear is locked against rotation. In this condition, the combined rotation of the planet gears will give a fractional speed increase (e.g., 5:6) to the main drum over the rotational speed of the bull gear.

Slack-pulling drum S also has a planetary drive transmission with a first input drive such as a set of planet gears 40*b* rotatably mounted on the spindles 30*a*. Thus the planet carrier rotates with the bull gear 26. The planet gears 40*b* mesh with an internal gear 42 and a sun gear 43. The sun gear forms part of a second input drive whereas the internal gear 42 forms part of an output drive. The internal gear is integrally attached to the inside of the slack-pulling drum S and the sun gear 43 is keyed to hollow shaft 44. Keyed respectively to the shafts 34 and 44 are bevel gears 45 and 46, which comprise a part of a differential drive mechanism. A bevel pinion 47 meshes with the gears 45 and 46, and is powered by a reversible secondary motive means, such as, hydraulic motor 48. The hydraulic motor 48 is powered by a manually controlled, directional control valve 50 which receives hydraulic flow from the pump 20*b*. Thus, control valve 50 provides via the second input drives a variable direction and/or variable speed control for the main and slack-pulling drums. By blocking flow through valve 50, the sun gears are locked, and the main and slack-pulling drums rotate in the same directions at the same speed. Providing variable speed and direction control to the pinion gear 47 will provide a variation between the relative speeds and possibly directions (depending upon the speeds of the drums) of the main and slack-pulling drums. For example, clockwise rotation of the pinion gear 47 will produce clockwise rotation of gear 45 and counterclockwise rotation of gear 46. Clockwise rotation of gear 45 will increase the speed of rotation in the same direction of the slack-pulling drum. Counterclockwise rotation of gear 46 will produce rotation in the opposite direction of the main drum if the primary drive 24 is stopped or almost stopped or a variation in relative speeds of the main and slack-pulling drums if the primary drive is fully driven.

Another planetary drive transmission 70 is provided for the haulback drum. This planetary drive transmission has a first input drive, such as, a planet carrier provided with spindles 50*a* and planet gears 50*b*. An internal gear 52 is integrally secured to the inside surface of the haulback drum and meshes with the planet gears. Similarly, a sun gear 53 meshes with the planet gears and is keyed to a shaft 54. The sun gear forms part of a second input drive whereas the internal gear 52 forms part of an output drive. Shaft 54 is keyed to a reduction gear 55 that is powered by a secondary motive means, such as, a fixed displacement hydraulic motor 57. The motor 57 is powered from a variable-displacement, reversible hydraulic pump 58 that is powered from a gear reduction drive 60 via bull gear 27.

As is well understood, each of the planetary drive transmissions may be provided with clutches or disconnect members to allow the drums to free-wheel for replacing worn cable. An additional straw drum 62, powered by a reversible motor 64, may be provided for auxiliary rigging. Furthermore, additional manually controlled valves, such as valve 66, can be provided to couple the pump 20*b* with auxiliary winch motors, if desired.

The operation is readily apparent. By locking motors 48 and 57 (swash plate in neutral) the inhaul drums M and S and outhaul drum HB will run in opposite directions at the same speed. This is the desired relationship generally at midspan. As the carriage leaves midspan, more cable will wrap on one set of drums and less on the other. The change in effective drum diameter will then result in a change in cable tension which an operator can detect either visually or by monitoring a pressure gauge as is well known. Adjustments to correct the cable tension during inhaul or outhaul can then be provided by adjusting the swash plate of the variable displacement pump 58 to speed up or slow down the haulback drum relative to the inhaul drums M and S. As described earlier, adjustment of the load carrying line 16*a* or the grapple can be provided during outhaul, inhaul, or while the carriage is stationary by controlling motor 48.

While the preferred embodiments of the invention have been illustrated and described, it should be understood that variations will be apparent to one skilled in the art without departing from the principles expressed herein. Accordingly, the invention is not to be limited to the specific embodiment illustrated.

The embodiments of the invention in which a particular property or privelege is claimed are defined as follows:

1. A yarder system for operating over the ground having main, haulback and slack-pulling drums with corresponding lines wrapped thereon, a carriage supported for movement by lines suspended above the ground, said main, haulback and slack-pulling lines being coupled to said carriage for moving the carriage outwardly by simultaneously pulling in the haulback line and paying out the main and slack-pulling lines and inwardly by simultaneously pulling in the main and slack-pulling lines and paying out the haulback line, a power supply, a reversible primary motive means, independent main, haulback and slack-pulling planetary drive transmissions, each planetary drive transmission having an output drive and first and second input drives, means coupling the first input drive of each of said planetary drive transmissions to said primary motive means, and hydraulic means coupled to the second input drive of said planetary drive transmission of said haulback drum for providing a variable interlock between the haulback drum and the main and slack-pulling drums and differential drive means coupled to said second input drives of said main and slack pulling planetary drive transmissions for providing a variation in both the relative rotational speeds and direction and the relative rotational speed or direction of the output drives of the main and slack-pulling drums.

2. The yarder system of claim 1, each said planetary drive transmission being housed within the confines of the drum.

3. The yarding system of claim 1, wherein said hydraulic means coupled to the second input drives of the planetary drive transmissions of each of the haulback, main and slack-pulling drums includes hydraulic secondary motors, and said differential drive means includes a differential drive train coupling one of said secondary motors to both said second input drives of said main and slack-pulling drums whereby a single secondary motor serves to provide differential speed control for the main and slack-pulling drums.

4. The yarding system of claim 3, each said planetary drive transmission including a planet carrier, said means coupling the first input drive of each planetary drive transmission to said primary motive means including a pinion gear driven by said primary motive means, a first bull gear meshed with said pinion gear and coupled to a planet carrier of said main and slack-pulling planetary drive transmissions and a second bull gear meshed with said first bull gear and coupled to the planet carrier of said haulback planetary drive transmission.

5. In a yarder for operating over the ground having main, haulback and slack-pulling drums with corresponding lines wrapped on said drums, a carriage supported for movement by lines suspended above the ground, said main, haulback and slack-pulling lines being coupled to said carriage for moving the carriage outwardly by simultaneously pulling in the haulback line and paying out the main and slack-pulling lines and inwardly by simultaneously pulling in the main and slack-pulling lines and paying out the haulback line, a power supply and a reversible primary motive means, the improvement comprising: a planetary drive transmission for each of the main, haulback and slack-pulling drums, each having two power input drives and an output drive, means coupling said primary motive means to a first of each said power input drives, hydraulic secondary motive means coupled to the second of said input drives of said haulback drum for providing a variable interlock between the haulback drum and the main and slack-pulling drums and wherein said planetary drive transmissions are each housed within the confines of said respective drums for reducing the cost and size of the yarder, said first of said input drives of each said planetary drive transmission including a planet carrier coupld to said primary motive means, a plurality of planet spindles coupled to said planet carrier, planet gears rotatably mounted on said planet spindles, said haulback output drive including a ring gear fixed to the interior of said haulback drum and having an internal gear meshed with said planet gears, said second of said input drives of each said planetary drive transmission including a sun gear meshed with said planet gears and a sun gear spindle fixed to said sun gear, said hydraulic secondary motive means being coupled to said sun gear spindle of said haulback drum planetary drive transmission, and means coupled to said second input drives of said main and slack-pulling planetary drive transmissions for providing a differential motion to the main and slack-pulling output drives.

* * * * *